United States Patent [19]

Greenhalgh

[11] Patent Number: 4,509,978

[45] Date of Patent: Apr. 9, 1985

[54] RECOVERABLE IMMOBILIZATION OF TRANSURANIC ELEMENTS IN SULFATE ASH

[75] Inventor: Wilbur O. Greenhalgh, Richland, Wash.

[73] Assignee: The United States of America as represented by the United States Department of Energy, Washington, D.C.

[21] Appl. No.: 447,569

[22] Filed: Dec. 7, 1982

[51] Int. Cl.[3] ..... C22B 60/02

[52] U.S. Cl. ..... 75/84.1 R; 252/628; 423/20

[58] Field of Search ..... 75/84.1 R, 84.1 A, 122.5; 252/628; 423/20

[56] References Cited

U.S. PATENT DOCUMENTS

| | | | |
|---|---|---|---|
| 2,848,796 | 8/1958 | Eubank | 29/194 |
| 2,848,797 | 8/1958 | Eubank | 29/194 |
| 2,875,041 | 2/1959 | Runnalls | 75/122.7 |
| 2,885,283 | 5/1959 | Schonfeld | 75/122.5 |
| 2,917,383 | 12/1959 | Saller | 75/214 |
| 3,052,536 | 9/1962 | Moore | 75/84.1 |
| 3,052,537 | 9/1962 | Moore | 75/84.1 |
| 3,188,202 | 6/1965 | Jones | 75/122.5 |
| 3,377,161 | 4/1968 | Zappi | 75/122.5 |
| 3,409,413 | 11/1968 | Burns | 423/20 |
| 3,957,676 | 5/1976 | Cooley et al. | 423/20 |
| 4,297,174 | 10/1981 | Brambilla et al. | 423/5 |

*Primary Examiner*—Brooks H. Hunt
*Assistant Examiner*—Anne Brookes
*Attorney, Agent, or Firm*—R. D. Fuerle

[57] ABSTRACT

Disclosed is a method of reversibly immobilizing sulfate ash at least about 20% of which is sulfates of transuranic elements. The ash is mixed with a metal which can be aluminum, cerium, samarium, europium, or a mixture thereof, in amounts sufficient to form an alloy with the transuranic elements, plus an additional amount to reduce the transuranic element sulfates to elemental form. Also added to the ash is a fluxing agent in an amount sufficient to lower the percentage of the transuranic element sulfates to about 1% to about 10%. The mixture of the ash, metal, and fluxing agent is heated to a temperature sufficient to melt the fluxing agent and the metal. The mixture is then cooled and the alloy is separated from the remainder of the mixture.

6 Claims, No Drawings

RECOVERABLE IMMOBILIZATION OF TRANSURANIC ELEMENTS IN SULFATE ASH

BACKGROUND OF THE INVENTION

The United States Government has rights in this invention pursuant to Contract No. DE-AC14-76FF02170 between the U.S. Department of Energy and the Westinghouse Electric Corporation and pursuant to Section 152 of the Atomic Energy Act of 1954.

To reduce the volume of combustible waste or scrap containing transuranic elements, one practice in the industry is to digest the waste in a sulfuric acid solution, and evaporate the acid (see U.S. Pat. No. 3,957,676). The result is a dry powder or cake of sulfate ash containing transuranic element sulfates. It is currently planned to package this powdered ash and send it to a Department of Energy plutonium reclamation center where the plutonium and other valuable elements can be recovered and purified.

However, the current backlog of plutonium materials waiting to be processed at these reclamation centers is so large that new scrap material cannot be processed for at least five more years. In the meantime, it is necessary to ship and store this material in a safe and stable form. While plutonium sulfate tetrahydrate, an analytical standard, has been shown to be chemically stable, alpha radiolytic decomposition of the sulfate, or residual volatile materials left in the residue solvent, such as moisture or trace sulfuric acid, could conceivably cause container pressurization without appreciable chemical change. More importantly, the final product of the acid digesstion process at the present time is a dry powder or cake which would be mechanically dispersed should a container be broken in shipping, handling, or in a pressurization accident. Any such accident could require extensive and expensive cleanup and would result in potential safety problems.

While the powdered sulfate ash product can be mixed with cement, glass, urea formaldehyde, or other resins to prevent mechanical dispersion, this would not permit a simple subsequent recovery of the plutonium and other elements from the product. In addition, these materials may require unusual processing conditions or expensive apparatus, and may create safety hazards during processing.

SUMMARY OF THE INVENTION

We have discovered that a powdered sulfate ash containing transuranic elements can be mechanically and chemically immobilized by converting the transuranic elements into an alloy of aluminum, cerium, samarium, or europium. This alloy is chemically very stable and prevents the mechanical dispersement of the transuranic elements. The alloy can be inexpensively and safely produced using conventional equipment.

A major advantage of the process of this invention is that the resulting alloy can be easily redissolved in a catalyzed nitric acid solution so that the transuranic elements can be recovered.

DESCRIPTION OF THE INVENTION

The ash that is treated by the process of this invention is produced when waste or scrap containing transuranic elements is digested by a sulfuric acid solution and the spent acid is vaporized. The resulting ash contains at least about 20% (all percentages herein are by weight) of the sulfates of various transuranic elements (i.e., elements 92 to 103). The ash may also include up to about 10% iron, about 1 to about 5% silicon, and up to about 10% miscellaneous metals, such as chromium, nickel, zinc, and aluminum.

In the first step of the process of this invention, a metal is added to the ash to form the alloy with the transuranic element. The metal may be aluminum, cerium, samarium, europium, or a mixture thereof. The preferred metal is aluminum because it has been found to work very well in combination with plutonium. The amount of metal added should be sufficient to form alloys with all the transuranic elements which are present, plus an additional amount sufficient to reduce the transuranic elements from positive oxidation states to a zero oxidation state. The additional amount added for reduction should be kept at a minimum, and it will not normally be necessary to add more than about a 15 to 20% excess to effect the reduction.

Also added to the ash is a sufficient amount of a fluxing agent to lower the percentage of the transuranic element sulfates in the total mixture to about 1% to about 10%. If the concentration of the sulfates is less than 1%, the advantages of this method diminish and other processes for treating the ash are more practical. While the process will work with concentrations of transuranic elements greater than about 10%, high concentrations make it difficult to control reaction parameters so that an efficient (>99%) extraction of transuranics can be made. Criticality safety for higher concentrations and fissile contents above 230 grams a batch should be checked although this method minimizes criticality safety problems by alloy displacement of spacial volume typically occupied by moderating solidification media in other methods.

The fluxing agent is used to dissolve any ash and also to provide an air cover barrier for the alloy. If the metal used is aluminum, a cryolite flux may be preferable although sodium fluoride or a lower melting cryolite/sodium fluoride mixture can be used. For the other metals, sodium fluoride is probably the best general fluxing agent, but a calcium fluoride generally used in a eutectic type mixture with cryolite or with sodium fluoride is also suitable.

The mixture of the ash, the metal, and the fluxing agent are then heated to a temperature sufficient to melt the fluxing agent and the metal reactant to permit the formation of the alloy. The alloy, being denser than the fluxing agent, will settle to the bottom of the reaction vessel. The mixture is then cooled to a solid and the alloy is separated from the remainder of the mixture. Separation can be accomplished mechanically by fracturing the fluxing agent, or the fluxing agent may be decanted off the alloy while it is still a liquid.

Recovery of the transuranic elements from the alloy can be accomplished by a variety of techniques, the most feasible of which is dissolution in nitric acid for all metals except aluminum which requires a mercury catalyst in addition to the nitric acid.

The following examples further illustrates this invention:

EXAMPLE

Into a reaction vessel was placed 10 grams of plutonium sulfate ash, 40 grams powdered aluminum, and 100 grams of cryolite. The mixture was heated at about 1050° C. for about 3 hours, and cooled to a solid. An alloy button of plutonium aluminum was mechanically removed from the flux after cooling with minimal effort. The alloy button weighed 38 grams and contained 14.5 weight percent plutonium. The reaction essentially went to completion with 99.6 weight percent of the plutonium being converted to the alloy and only 0.4% or less of the plutonium remaining in the 100 grams of cryolite flux.

I claim:

1. In a process for reclaiming transuranic elements from a sulfate ash made by digesting combustible wastes in sulfuric acid, an improved method of immobilizing said transuranic elements in a physically and chemically stable form, and of subsequently recovering said transuranic elements therefrom, comprising:

(1) adding to said ash metal selected from the group consisting of aluminum, cerium, samarium, europium, and mixtures thereof, in an amount sufficient to form alloys with said transuranic elements plus an additional amount sufficient to reduce said transuranic elements to elemental form;

(2) adding to said ash sufficient fluxing agent to lower the weight percentage of said transuranic element sulfates to about 1 to about 10%;

(3) heating the mixture of said ash, metal, and fluxing agent to a temperature sufficient to melt said fluxing agent and said metal;

(4) cooling said mixture to a solid;

(5) separating said alloys from the remainder of said mixture; and (6) dissolving said alloy in a solution comprising nitric acid.

2. A method according to claim 1 wherein said metal is aluminum.

3. A method according to claim 1 wherein said fluxing agent is selected from the group consisting of cryolite, sodium fluoride, or mixtures thereof.

4. A method according to claim 3 wherein said mixture is heated at about 1000° C. to about 1100° C.

5. A method according to claim 1 wherein said transuranic element is plutonium.

6. A method according to claim 1 wherein the amount of said metal is about 15 to about 20 weight % in excess of the amount required to form said alloys and reduce said sulfates.

* * * * *